United States Patent [19]

Woodward

[11] Patent Number: 4,570,134

[45] Date of Patent: Feb. 11, 1986

[54] COMPACT HYBRID PROVIDING QUADRATURE PHASE RELATION BETWEEN TWO OUTPUTS

[75] Inventor: Oakley M. Woodward, Princeton, N.J.

[73] Assignee: RCA Corporation, Princeton, N.J.

[21] Appl. No.: 602,157

[22] Filed: Apr. 19, 1984

[51] Int. Cl.[4] ..... H01P 5/19

[52] U.S. Cl. ..... 333/123; 333/127

[58] Field of Search ..... 333/115, 121, 123, 127, 333/136

[56] References Cited

U.S. PATENT DOCUMENTS

| | | | |
|---|---|---|---|
| 2,510,064 | 6/1950 | Bryan | 333/136 |
| 2,633,531 | 3/1953 | Nelson | 333/127 X |
| 2,667,619 | 1/1954 | Raymond | 333/127 |
| 2,897,456 | 7/1959 | Geppert | 333/127 |
| 4,127,831 | 11/1978 | Riblet | 333/115 X |
| 4,367,445 | 1/1983 | Dydyk | 333/127 |

OTHER PUBLICATIONS

Antennas by J. D. Kraus, pp. 426 and 427, published by McGraw-Hill Book Company, Inc. 1950.

Microwave Transmission Design Data by Theodore Moreno, p. 39, published by Dover Publications, Inc., New York.

*Primary Examiner*—Paul Gensler

*Attorney, Agent, or Firm*—E. M. Whitacre; D. H. Irlbeck; T. H. Magee

[57] ABSTRACT

A hybrid uses stubs to provide 90 degrees of phase shift between output lines for feeding a circularly polarized antenna. Capacitive and inductive stubs have low and high characteristic impedances for broad bandwidth. The stubs can be located in the output lines for compactness, or in a T-section between an input line and the output lines, for compactness, to minimize undesired phase shift, and for ease of connection. The hybrid can include one quarter wave transformers having a characteristic impedance of geometric mean of the hybrid and antenna for improved axial ratio.

13 Claims, 8 Drawing Figures

COMPACT HYBRID PROVIDING QUADRATURE PHASE RELATION BETWEEN TWO OUTPUTS

BACKGROUND OF THE INVENTION

The present invention relates to a hybrid for providing a pair of 90 degree phase shifted signals to a pair of antennas, and more particularly, to such a hybrid that is arranged for compactness and is broadband.

Interest has grown in using circular polarization (CP) for television broadcasting in order to reduce ghosts and fading. One way of achieving CP is to use a pair of dipoles disposed at a right angle with respect to each other and fed with equal currents and in phase quadrature, i.e., with 90 degrees of phase shift therebetween.

In order to achieve the required quadrature phase shift, a four port hybrid comprising a line having a length of one quarter wavelength at a selected center frequency can be used. Such a hybrid has an input port, a port terminated in its characteristic impedance, and two unbalanced output ports at opposite ends thereof. However, this type of hybrid is bulky due to the length of said line and requires flexible coaxial cables to extend from the two output ports, which are at opposite sides of said hybrid, through tubes comprising baluns, which baluns are required to feed the dipoles, since the dipoles are a balanced load.

Another type of hybrid used lumped elements, as shown in FIG. 1. A coaxial cable is connected with its center conductor connected to terminal 10 and its outer shield to terminal 12. Resistors 14 and 16 represent the load resistance R presented by each of a pair of dipoles respectively, having currents $I_1$ and $I_2$, respectively, flowing therein. If, at a selected center frequency, the reactances of inductor 18 and capacitor 20 are made equal to $+jR$ and $-jR$, respectively, then $I_1$ and $I_2$ are equal in magnitude and in phase quadrature. Further, the input impedance at terminals 10 and 12 is just R. However, this type of hybrid has stray fields from components 18 and 20 to each other and to the shielded box that normally surrounds them. This can make the currents unequal and not in phase quadrature. In addition, the inductor 18, when designed for use at a high frequency, e.g., high band VHF channels 7–13, is small and therefore difficult to reproduce.

Yet another type of hybrid uses short and open circuited transmission lines to provide inductance and capacitance respectively, to replace inductor 18 and capacitor 20, respectively, of FIG. 1. However, when these transmission lines have a characteristic impedance of 50 ohms, it has been found that the resulting bandwidth of the driven antenna as determined by its axial ratio (AR) is less than that of the lumped element hybrid of FIG. 1. By "AR" is meant the ratio of maximum to minimum linear fields strengths.

It is, therefore, desirable to provide a hybrid that is compact, has a broad bandwidth, and is easy to manufacture to the required tolerances so that the output signals are of substantially equal amplitude and in phase quadrature.

SUMMARY OF THE INVENTION

A hybrid comprises an input transmission line and a pair of output lines for providing output signals e.g., to a pair of crossed dipole antenna elements of a CP antenna. Short and open circuited stubs are used to provide inductance and capacitance respectively so the output signals are in a quadrature phase relationship. The short and open circuited stubs have a relatively high and low characteristic impedance, respectively, resulting in a relatively broad bandwidth. The stubs can be disposed in hollow inner conductors of the output lines to obtain compactness. Alternately, the inductive stub can be placed in the hollow inner conductor of the input line and the capacitive stub can be disposed between one output line and the input line to minimize undesired phase shifts. A pair of matching lines coupled between the hybrid and the antenna elements can also be used to achieve a better axial ratio over a broad bandwidth.

DETAILED DESCRIPTION

Figure 1:
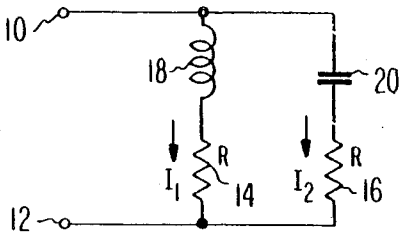
Fig. 1 PRIOR ART
FIG. 1 is a schematic circuit diagram of a lumped element quadrature hybrid in accordance with the prior art described above.
Figure 2:
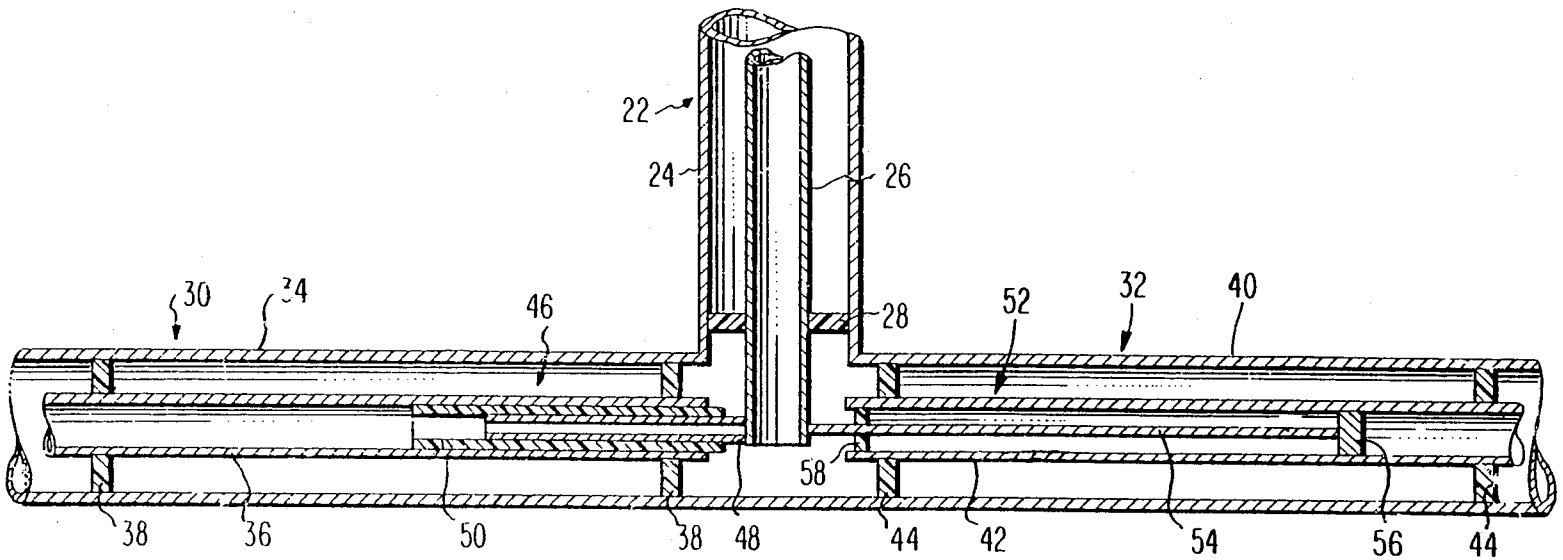
FIG. 2 is a cross-sectional view of a hybrid using stubs of different characteristic impedance in accordance with a first embodiment of the invention.

As shown in FIG. 2, an input coaxial transmission line 22 coupled to a transmitter (not shown) and having a 50 ohm characteristic impedance comprises an outer conductor 24 and a hollow inner conductor 26 centered within outer conductor 24 by insulating spacer 28. Input line 22 is coupled to a pair of quadrature phase output lines 30 and 32, which output lines are respectively coupled to a pair of antennas (not shown). In similar fashion to input line 22, output line 30 comprises hollow outer conductor 34 and a hollow inner conductor 36 centered within outer conductor 34 by insulating spacer 38. Output line 32 extends in the opposite direction from line 30 and comprises hollow outer conductor 40 and a hollow inner conductor 42 centered within outer conductor 40 by insulating spacer 44. The characteristic impedance of output lines 30 and 32 is 50 ohms.

To provide the required series capactive and inductive reactance equal to the antenna load resistance, e.g., 50 ohms, coaxial stubs 46 and 52 are used in series with lines 30 and 32, respectively. Stubs 46 and 52 are respectively disposed within inner conductors 36 and 42 for compactness.

Coaxial stub 46 comprises an inner conductor 48 and an outer conductor 36, which conductor 36 is also the inner conductor of line 30. Conductor 48 is connected at one end (near end) to inner conductor 26. An insulating sleeve 50 is disposed between conductors 48 and 36. Conductor 48 is open at its end remote from conductor 26 (far end) and less than one quarter of a wavelength long, (about 9.43 electrical degrees long) at 195 MHz, and thus stub 46 provides capacitive reactance in series with lines 22 and 30. The outer diameter of conductor 48, as well as the dielectric constant of sleeve 50, are large so that stub 46 has relatively low characteristic impedance, e.g., 8.3 ohms. This provides a relatively large bandwidth for the frequency range of operation of stub 46. I.E., the low impedance decreases the reactance change with changes in frequency of stub 46 as compared with using a 50 ohm stub. Sleeve 50 extends beyond the far end of inner conductor 48 and beyond the near end of conductor 36 so that the dielectric material e.g., "Teflon", is present in the fringing fields of stub 46 to help prevent breakdown.

Coaxial stub 52 comprises an inner conductor 54, and an outer conductor 42, which conductor 42 is also the inner conductor of line 32. Inner conductor 54 of stub 52 is short circuited to outer conductor 42 at its far end by shorting disk 56. Inner conductor 54 is centered and supported at its near end by insulating disk 58. Since stub 52 is shorter than one quarter of a wavelength (about 19.36 electrical degrees long) at 195 MHz, it provides inductive reactance in series with lines 22 and 32. The diameter of inner conductor 54 is made small so that stub 52 has a relatively high characteristic impedance, e.g., 142.3 ohms. This provides a relatively broad bandwith for the frequency range of operation of stub 52. I.E., the high impedance decreases the reactance change of stub 52 with changes in frequency. Since the reactance (phase shift) changes of stubs 46 and 52 change less over the bandwidth than stubs having a 50 ohm impedance, it can be shown that the AR and SWR change less over said bandwidth.

Figure 3:
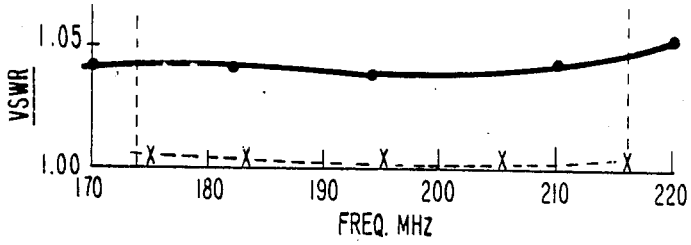
FIG. 3 is a graph of the standing wave ratio (SWR) of the embodiment of FIG. 2.

FIG. 3 shows a graph of the calculated (dashed line) and measured (solid line) SWR of the embodiment of FIG. 2 over the very high frequency (VHF) television broadcast high band (174–216 MHz) using ideal 50 ohm loads in place of actual antennas. It will be seen that the SWR is at or below 1.05 over the entire band. The deviation of the measured from the calculated is attributed to the use of conical-shaped adapters (not shown) used at all three ports to reduce the diameters of lines 22, 30, and 32 to match that of conventional flexible coaxial transmission lines.

Figure 4:
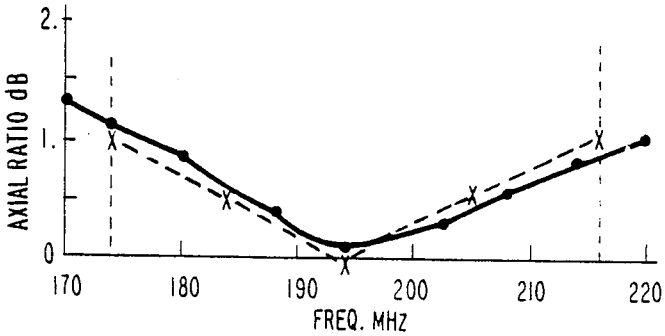
FIG. 4 is a graph of the AR of the embodiment of FIG. 2.

FIG. 4 shows the measured (solid line) and calculated (dotted line) AR expressed in db of the embodiment of FIG. 2 over the VHF high band when driving a pair of orthogonal dipoles. It will be seen that the maximum value slightly exceeds 1 db, which is acceptable.

Figure 5:
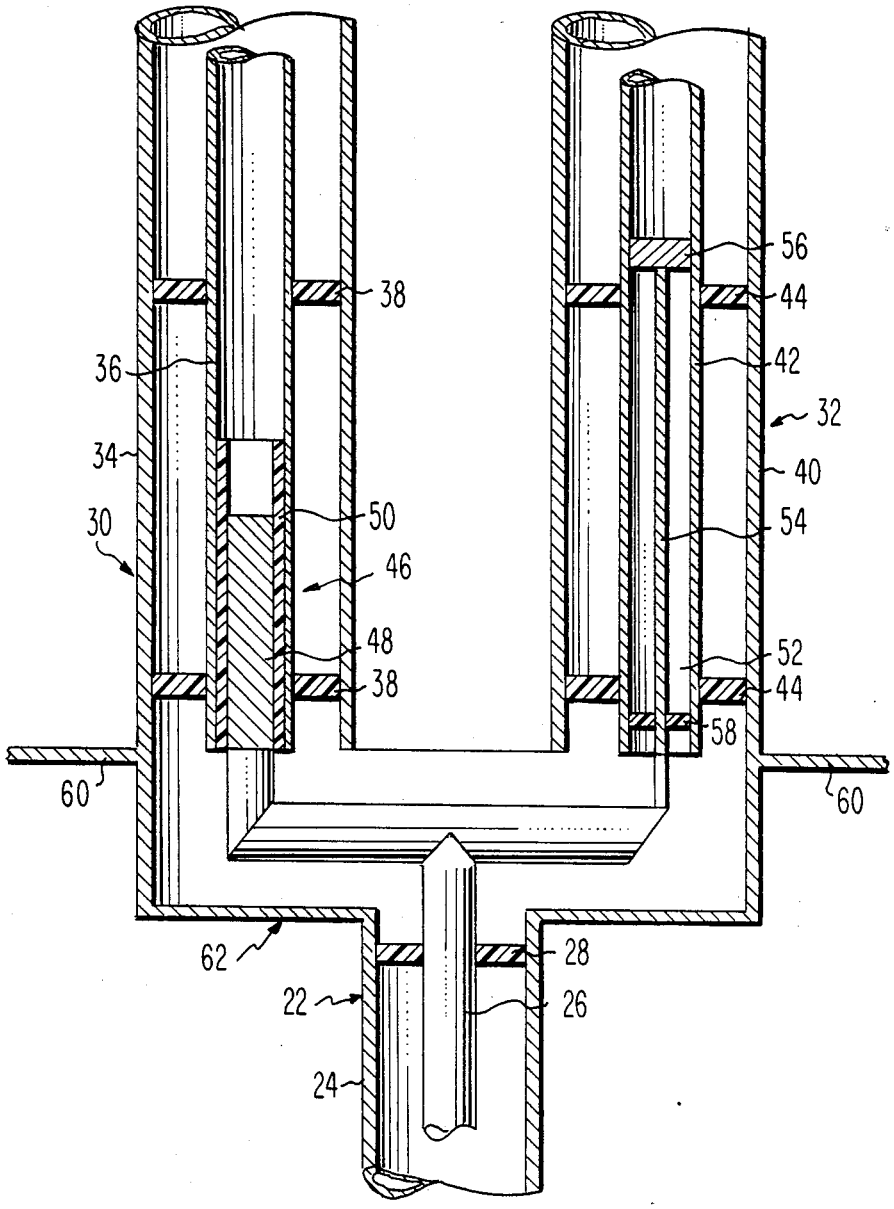
FIG. 5 is a cross-sectional view of a second embodiment of the invention with the stubs arranged for compactness.

FIG. 5 shows a second embodiment of the invention, wherein elements corresponding to those of the embodiment shown in FIG. 2 have the same reference numbers. This embodiment is arranged for compactness by having output lines 30 and 32 extend parallel to each other (and to line 22) and perpendicular to a reflecting screen 60, which screen 60 is used to increase the gain of the antennas (not shown). Input line 22 is coupled to output lines 30 and 32 by way of a T-shaped section 62. The characteristic impedances of the lines 22, 30, and 32 are the same as in FIG. 2.

A problem with the embodiment of FIG. 5 is that the T-section 62 causes small phase shifts in the signals being applied to output lines 30 and 32, which phase shifts are in addition to that caused by stubs 30 and 32 and, therefore, may cause the AR to be greater than desired.

Figure 6:
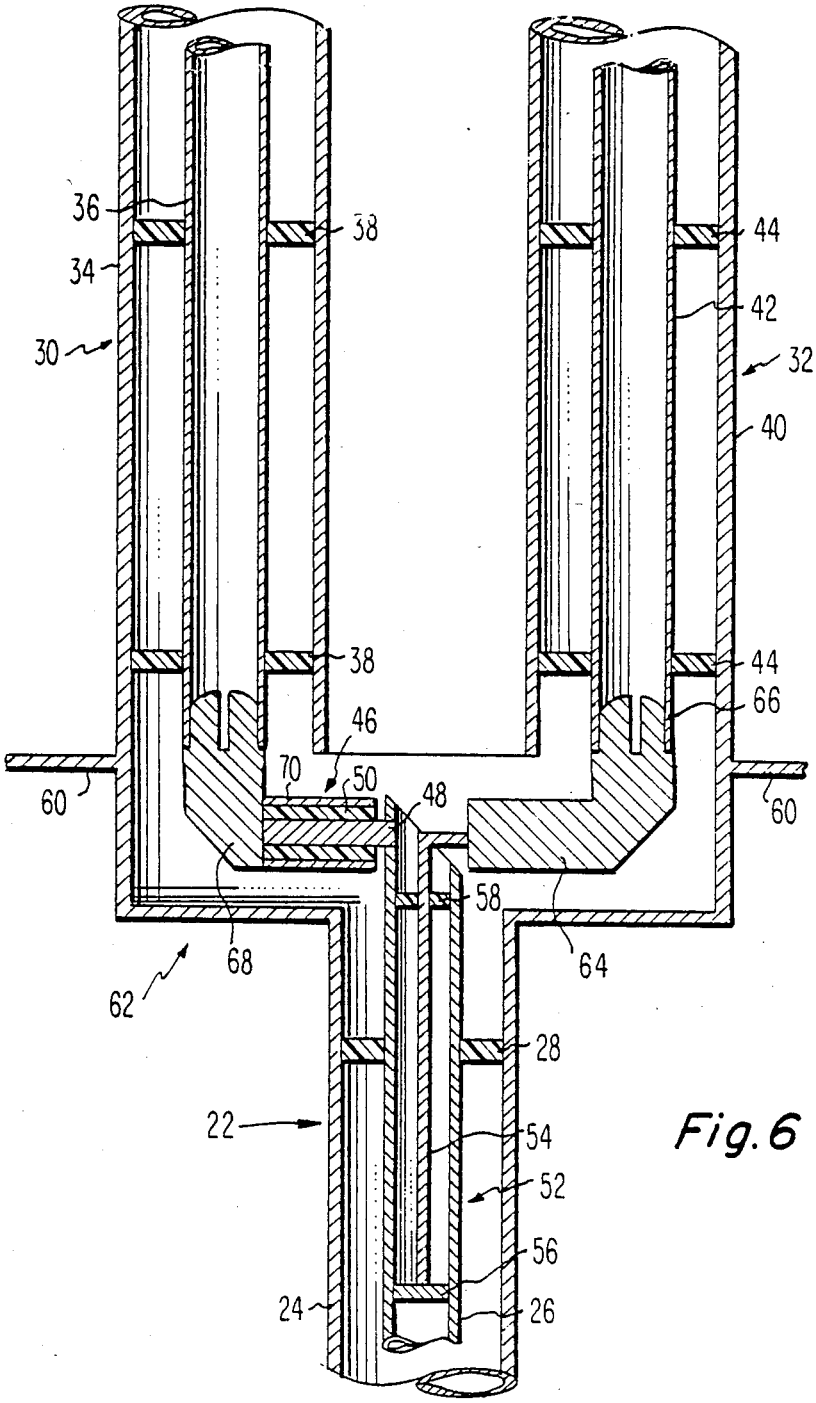
FIG. 6 is a cross-sectional view of a third embodiment of the invention with the stubs also arranged for compactness.

FIG. 6 shows a third embodiment of the invention which substantially eliminates the above problem. In FIG. 6, elements corresponding to those of FIGS. 2 and 5 have the same reference numbers. This embodiment is geometrically similar to that of FIG. 5 However, in this embodiment inductive stub 52 is formed with its inner conductor 54 disposed in conductor 26 of input line 22, which conductor 26 is therefore also the outer conductor of stub 52. Conductor 54 is short circuited to conductor 26 by disk 56. Conductor 54 is coupled to inner conductor 42 of output line 32 through a right angle solid "bullet connector" 64 having an end 66 that plugs into the open end of conductor 42. Capacitive stub 46 is disposed in T-section 62. Inner conductor 48 is coupled to conductor 26 and is surrounded by insulating sleeve 50. Conductor 70, which is the outer conductor of stub 46 and comprises a portion of the inner conductor of the left hand portion of T-section 62, is coupled to a right angle solid "bullet connector" 68 that plugs into the open end of inner conductor 36. The characteristic impedances of the lines 22, 30, and 32 are the same as in FIGS. 2 and 5.

In the equivalent electrical circut of the embodiment of FIG. 6, stubs 46 and 52 are in series with the input line 22 and output lines 30 and 32, respectively, right at the center of T-section 62. It will thus be seen that the undesired phase shifts caused by the T-section 62 in the embodiment of FIG. 5 are replaced by the desired phase shifts of stubs 46 and 52 in the embodiment of FIG. 6. Further, the embodiment of FIG. 6 can easily be plugged into existing antenna feedlines 30 and 32 without the need for flexible feedlines or connectors.

In a typical application, the power flowing to each antenna can be as high as 4000 watts. In the above described embodiments the maximum voltage at the open end of capacitive stub 46 will only be 411 volts, while the maximum current at the short circuited end of inductive stub 52 will only be 4.74 amperes for this power. The above embodiments will easily handle these requirements.

Figure 8:
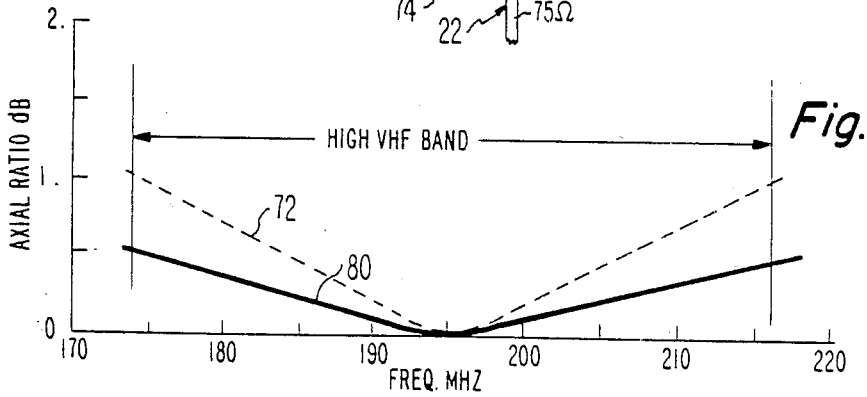
FIG. 8 is a graph of the AR of the embodiment of FIG. 7.

In the embodiments of FIGS. 2, 5, and 6, as described above, input line 22, output lines 30 and 32, and the antennas were all assumed to have the same impedance, e.g., 50 ohms. Stubs 46 and 52 each have a signed value of reactance that increases with increases in frequency i.e., a graph of reactance versus frequency has a positive slope. This causes the AR to increase to about 1 db at the band edges (174 and 216 MHz) of a high VHF band embodiment as shown by curve 72 in FIG. 8, which is a graph of AR in db versus frequency in MHz.

Figure 7:
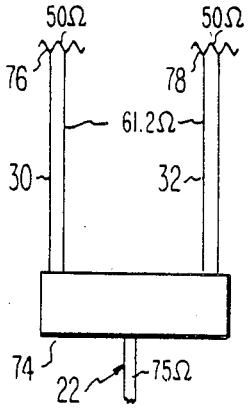
FIG. 7 is a diagram of a feed system in accordance with the invention for a broadband AR.

FIG. 7 shows another embodiment of the invention with improved AR. As shown therein, input line 22 having a characteristic impedance of 75 ohms is coupled to a 75 ohm-to-75 ohm hybrid 74 in accordance with one of the above described embodiments, i.e., the stubs 46 and 52 therein have a reactance of 75 ohms at the center frequency of the range of interest. Output lines 30 and 32 are coupled to hybrid 74 and to antennas 76 and 78 respectively. Antennas 76 and 78 have an input impedance of 50 ohms. In this embodiment, lines 30 and 32 have an electrical length of one quarter (or an odd integer multiple thereof) of a wavelength and an impedance equal to the geometric mean (square root of the product) of 50 and 75 ohms, i.e., 61.2 ohms. Thus, lines 30 and 32 comprise matching transformers. The signed value of the reactance of such transformers decreases with increases in frequency, i.e., a graph of reactance versus frequency has a negative slope, thereby partially cancelling the increasing reactance with increasing frequency of stubs 46 and 52. The result is that the AR increases less at band edges as shown by curve 80 in FIG. 8.

What is claimed is:

1. Apparatus comprising:

an input coaxial transmission line having a first characteristic impedance;

a pair of output coaxial transmission line for coupling signals to a pair of loads, respectively;

first and second coaxial stubs coupled between said output lines, respectively, and said input line, said first and second stubs providing capacitive and inductive reactances, respectively, and having lower and higher characteristic impedances, respectively, than said first characteristic impedance in that the ratio of the outer diameter of the inner conductor to the inner diameter of the outer conductor for said first stub is larger than that same ratio for said second stub, to form a broad band hybrid for providing signals having a quadrature phase relation with respect to each other to said output coaxial transmission lines.

2. Apparatus as claimed in claim 1, wherein said output transmission lines extend in opposite directions with respect to each other.

3. Apparatus as claimed in claim 1, wherein said output transmission lines are substantially parallel.

4. Apparatus as claimed in claim 1, wherein each of said output transmission lines comprises a hollow inner conductor, said stubs being respectively disposed in said inner conductors.

5. Apparatus as claimed in claim 4, wherein said stubs respectively comprise said hollow conductors as the outer conductor thereof.

6. Apparatus as claimed in claim 1, wherein said input transmission line comprises a hollow inner conductor, said second stub being disposed within said hollow inner conductor; and said first stub being disposed between said inner conductor and one of said output lines.

7. Apparatus as claimed in claim 6, wherein said second stub comprises said hollow inner conductor as the outer conductor thereof.

8. Apparatus as claimed in claim 1, wherein:

said loads each have a second characteristic impedance; and said output lines have a third characteristic impedance substantially equal to the geometric mean of said first and second characteristic impedances.

9. Apparatus comprising:

an input coaxial transmission line having a hollow inner conductor and a first characteristic impedance;

a pair of parallel output coaxial transmission lines for coupling signals to a pair of loads respectively; and first and second stubs coupled between said output lines, respectively, and said inner conductor of said input line and providing capacitive and inductive reactance, respectively, said first stub being disposed between said inner conductor of said input line and one of said output lines, said second stub being disposed within said hollow inner conductor of said input line, said stubs coupling signals having a quadrature phase relationship with respect to each other to said output coaxial transmission lines.

10. Apparatus as claimed in claim 9, wherein said second stub comprises said hollow inner conductor as the outer conductor thereof.

11. Apparatus as claimed in claim 9, wherein said loads each have a second characteristic impedance; and said output lines have a third characteristic impedance substantially equal to the geometric means of said first and second characteristic impedances.

12. Apparatus comprising:

a hybrid having a pair of coaxial stubs for providing signals having a quadrature phase shift with respect to each other, via outputs thereof to a pair of loads, respectively, said stubs having a reactance characterized by the ratio of the outer diameter of the inner conductor to the inner diameter of the outer conductor for one stub being larger than that same ratio for the other stub, said loads having a resistance; and a pair of matching lines coupled between said outputs and said loads, respectively, and having an impedance of substantially the geometric mean of said resistance and said reactance.

13. Apparatus as claimed in claim 12, wherein said matching lines have an electrical length of one quarter of a wavelength at a selected frequency or an odd multiple thereof.

* * * * *